US007669511B2

(12) United States Patent
King

(10) Patent No.: US 7,669,511 B2
(45) Date of Patent: Mar. 2, 2010

(54) SHAVING PRODUCT

(75) Inventor: William Ashley King, Buckinghamshire (GB)

(73) Assignee: Knowledge & Merchandising, Inc. Limited, Chesham (GB)

( * ) Notice: Subject to any disclaimer, the term of this patent is extended or adjusted under 35 U.S.C. 154(b) by 174 days.

(21) Appl. No.: 11/498,825

(22) Filed: Aug. 4, 2006

(65) Prior Publication Data

US 2007/0028449 A1 Feb. 8, 2007

Related U.S. Application Data

(62) Division of application No. 10/732,220, filed on Dec. 11, 2003, now Pat. No. 7,100,284.

(30) Foreign Application Priority Data

Nov. 17, 2003 (GB) ..... 0326772.1

(51) Int. Cl.
*B26B 21/52* (2006.01)
*B26B 21/16* (2006.01)

(52) U.S. Cl. ..... 83/526; 83/49; 83/50; 83/57; 83/527

(58) Field of Classification Search ..... 30/49, 30/50, 34.05, 41, 346.57, 526, 45, 47, 532, 30/41.6, 527, 530, 533, 57, 58, 41.5, 51, 30/77, 78, 346.5, 346.55
See application file for complete search history.

(56) References Cited

U.S. PATENT DOCUMENTS 1,024,509 A 4/1912 Harrison
1,423,414 A 7/1922 Glaser
2,119,405 A 5/1938 Osborne
3,311,975 A * 4/1967 De Longuyon ..... 30/62
3,407,496 A 10/1968 Pomper
3,657,810 A * 4/1972 Nissen ..... 30/63
3,777,396 A 12/1973 Simonetti
3,842,502 A 10/1974 Hagan
3,892,036 A * 7/1975 Perry ..... 30/62
4,057,896 A 11/1977 Trotta
4,459,744 A * 7/1984 Esnard ..... 30/49
4,599,793 A * 7/1986 Iten ..... 30/47

(Continued)

FOREIGN PATENT DOCUMENTS

DE 3 635 553 A1 4/1988

(Continued)

*Primary Examiner*—Ghassem Alie
(74) *Attorney, Agent, or Firm*—Dickstein Shapiro LLP

(57) ABSTRACT

A razor head has blade members with straight front cuffing edges which are mutually parallel and lie in a cutting plane. Imaginary median surfaces of the blade members are continuously curved from the cutting plane, from the cutting edges toward the rear edges. The razor has a handle with a pair of fork arms, the distal ends of which are connected to the head at positions adjacent the respective ends of the head. Each fork arm has a groove allowing pivoting of the distal end about a pivot axis parallel to the head axis but which does not pass through the razor head. Each groove is filled with a resiliently deformable material which is deformed when a pivoting force is applied to the razor head during shaving and which restores the razor head to a normal position when the force is removed.

10 Claims, 14 Drawing Sheets

U.S. PATENT DOCUMENTS

| | | | | |
|---|---|---|---|---|
| 4,658,505 | A | 4/1987 | Williams | |
| 4,774,765 | A | 10/1988 | Ferraro | |
| 4,797,998 | A | 1/1989 | Motta | |
| 4,903,405 | A | 2/1990 | Halevy | |
| 5,038,472 | A * | 8/1991 | Iderosa | 30/527 |
| 5,182,858 | A * | 2/1993 | Chen | 30/530 |
| 5,313,706 | A | 5/1994 | Motta et al. | |
| 5,359,774 | A | 11/1994 | Althaus | |
| 5,365,665 | A | 11/1994 | Coffin | |
| 5,537,749 | A | 7/1996 | Cacioppo | |
| 5,551,153 | A | 9/1996 | Simms | |
| 5,590,468 | A | 1/1997 | Prochaska | |
| 5,678,316 | A | 10/1997 | Althaus et al. | |
| 6,035,537 | A | 3/2000 | Apprille, Jr. et al. | |
| 6,161,287 | A | 12/2000 | Swanson et al. | |
| 6,185,823 | B1 | 2/2001 | Brown et al. | |
| 6,311,400 | B1 * | 11/2001 | Hawes et al. | 30/527 |
| 2002/0020065 | A1 | 2/2002 | Tseng | |
| 2005/0060898 | A1 * | 3/2005 | Tomassetti et al. | 30/527 |

FOREIGN PATENT DOCUMENTS

| | | | |
|---|---|---|---|
| EP | 0 429 174 | A3 | 5/1991 |
| EP | 0 885 697 | A1 | 12/1998 |
| EP | 0 903 205 | A1 | 3/1999 |
| EP | 1 053 837 | A | 11/2000 |
| EP | 1 340 600 | A1 | 9/2003 |
| EP | 1 356 901 | A1 | 10/2003 |
| FR | 821 030 | A | 11/1937 |
| FR | 973 077 | | 2/1951 |
| GB | 714122 | | 8/1954 |
| GB | 2055 069 | | 2/1981 |
| WO | WO 86/02310 | | 4/1986 |
| WO | WO 98/05479 | | 2/1998 |
| WO | WO 00/37227 | | 6/2000 |

* cited by examiner

SHAVING PRODUCT

This is a divisional application of Ser. No. 10/732,220, filed Dec. 11, 2003, now U.S. Pat. No. 7,100,284, the disclosure of which is incorporated herein by reference in its entirety.

BACKGROUND OF THE INVENTION

1. Field of the Invention

This invention relates to shaving products in general and, in particular, to razor blades, razor heads, which may be disposable, razor handles, and razors.

2. Background Art

Razors having a handle and a disposable head are well known. A razor head will typically have three parallel blade members. The head may be mounted on the handle in such a way that the head rocks relative to the handle.

BRIEF SUMMARY OF THE INVENTION

In one aspect the present invention provides a razor blade which curves continuously away from the cutting edge.

In another aspect the present invention provides a razor head in which a plurality of blades are clamped between first and second head parts.

In another aspect the present invention provide a razor handle which has a groove allowing pivoting of the distal end of the handle about an axis transverse to a handle axis.

In another aspect the invention provides a razor in which a razor head is removably fixed to a forked handle.

In particular, in one aspect, the invention provides a razor head including a plurality of blade members, each having a straight front cutting edge and a rear edge, the cutting edges being mutually parallel and lying in a cutting plane, each blade member having an outer surface facing toward the cutting plane and an opposite inner surface, with an imaginary median surface mid-way between the outer and inner surfaces, the median surfaces of the blade members being continuously curved in the same sense away from the cutting plane, from the cutting edges toward the rear edges.

In another aspect the invention provides a razor head comprising at least one blade member having a cutting edge, and a frame defining an opening through which the cutting edge is accessible, the frame including a leading element toward which the cutting edge are directed and a trailing element opposite the leading element, wherein at least one of the leading and trailing elements has a longitudinal gutter in which a lubricating liquid accumulates during shaving.

In another aspect the invention provides a razor handle for a razor including a razor head having at least one blade member with a cutting edge extending along a head axis transverse to a handle axis, the razor handle having a front end portion, the distal end of which is connectable or connected to the head, the front end portion having a groove allowing pivoting of the distal end about a pivot axis parallel to the head axis, the groove containing a resiliently deformable material which is deformed when a pivoting force is applied to the distal end by the by the razor head during shaving and which restores the distal end to a normal position when the force is removed.

In another aspect the invention provides a razor comprising a handle and a razor head having at least one blade member with a cutting edge extending along a head axis transverse to a handle axis, the handle having a forked front end portion with a pair of fork arms, the distal ends of which are connected to the head at positions adjacent the respective ends of the head, the head having undercut apertures in rear abutment surfaces, the distal ends of the fork arms having detent elements projecting forwardly from front abutment surfaces, the front and rear abutment surfaces abutting against one another and the detent elements engaging in the undercut apertures in such a manner that the head is fixed relative to the distal ends of the fork arms, the distal ends being movable toward one another to disengage the detent elements form the undercut apertures and allow the head to be removed from the handle, the distal ends being pivotable about an axis parallel to the head axis when a pivoting force is applied to the razor head during shaving.

In another aspect the invention provides a razor comprising an elongate handle and a head connected to the handle, the head including at least one blade member having a cutting edge, the head defining a shaving surface toward which the cutting edge is directed and a reverse surface opposite the shaving surface, the handle having a front end portion connected to the head between the shaving surface and the reverse surface, the handle being angled away from a plane tangential to the shaving surface.

Preferred and optional features are set out in the following description and in the claims.

DETAILED DESCRIPTION OF THE INVENTION

The drawings illustrate the presently preferred embodiment of a razor. It is to be noted that the drawings are not to scale.

Figure 1:
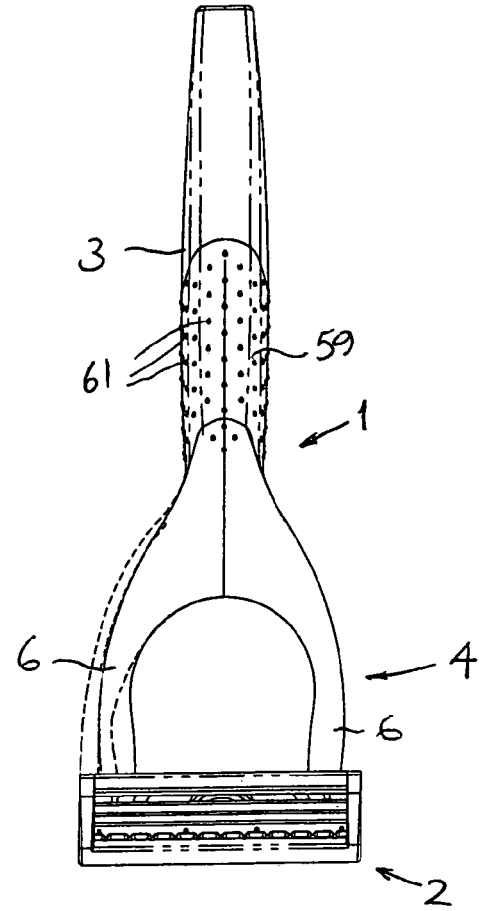
FIG. 1 shows a razor, viewed from the bottom or underside, which is the side facing the skin during shaving.
Figure 2:
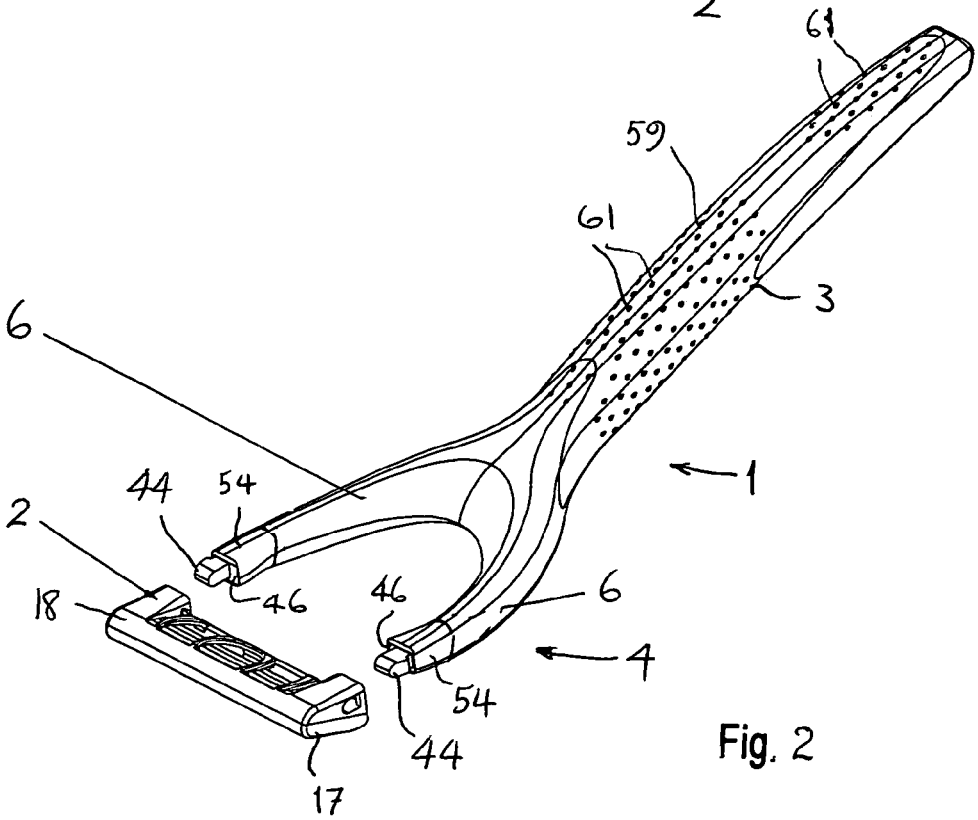
FIG. 2 is a perspective view of the razor, viewed from above, with the razor head and handle separated.

The razor comprises a forked handle 1 and a replaceable head 2. The handle 1, which is used to draw the head across the user's skin, has a gently curved shank 3, the front end of which merges into the forked front end portion 4 which is generally U shaped and has a pair of fork arms 6 which are mirror-symmetrical with respect to an imaginary plane longitudinally bisecting the shank 3. By squeezing the arms 6 it is possible to push them inwards slightly, in FIG. 1 the normal position of one arm 6 is shown in broken line at the left-hand side, whereas an inwardly pushed position of both of the arms 6 is shown in solid line. The arms 6 are resiliently flexible, so that they naturally return to their normal position.

The razor head 2 includes three blade members 7 which are identical to each other and each made of a single sheet of material, which maybe a metallic, ceramic, or metalloceramic material. Alternatively, a blade member may be made of separate parts joined together, e.g. a front part containing a cutting edge and rear part connected to the front end. Each blade member 7 has a straight front cutting edge 8 and a rear edge parallel to it. Apart from the sharpened portion 11 with the cutting edge 8, the blade member 7 is of constant thickness in the embodiment illustrated.

Figure 10:
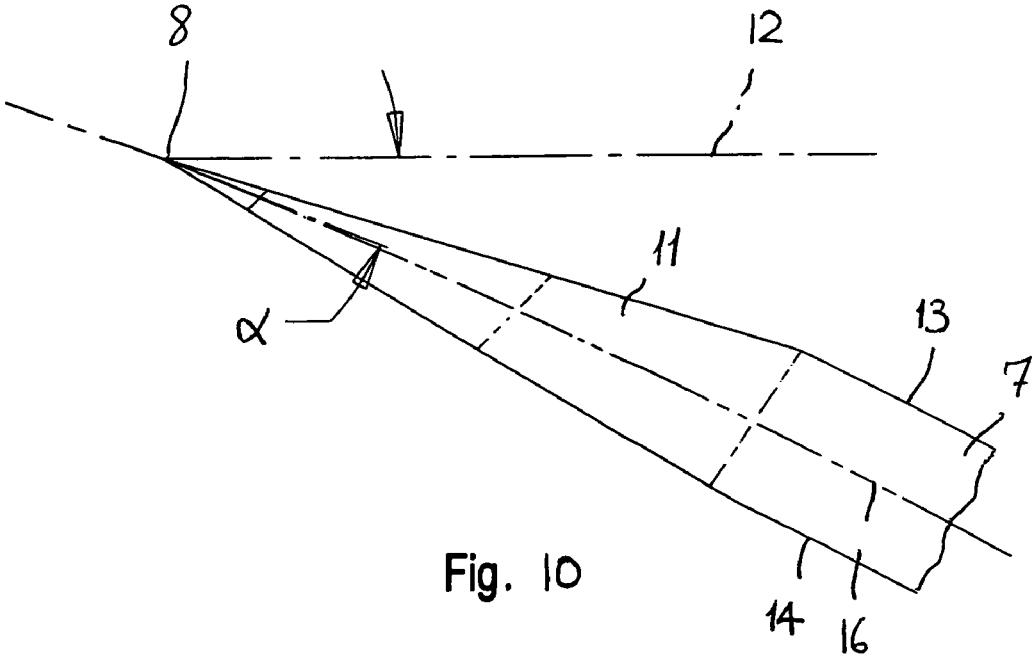
FIG. 10 is an enlarged side view of the cutting edge portion of one of the blade members.
Figure 11:
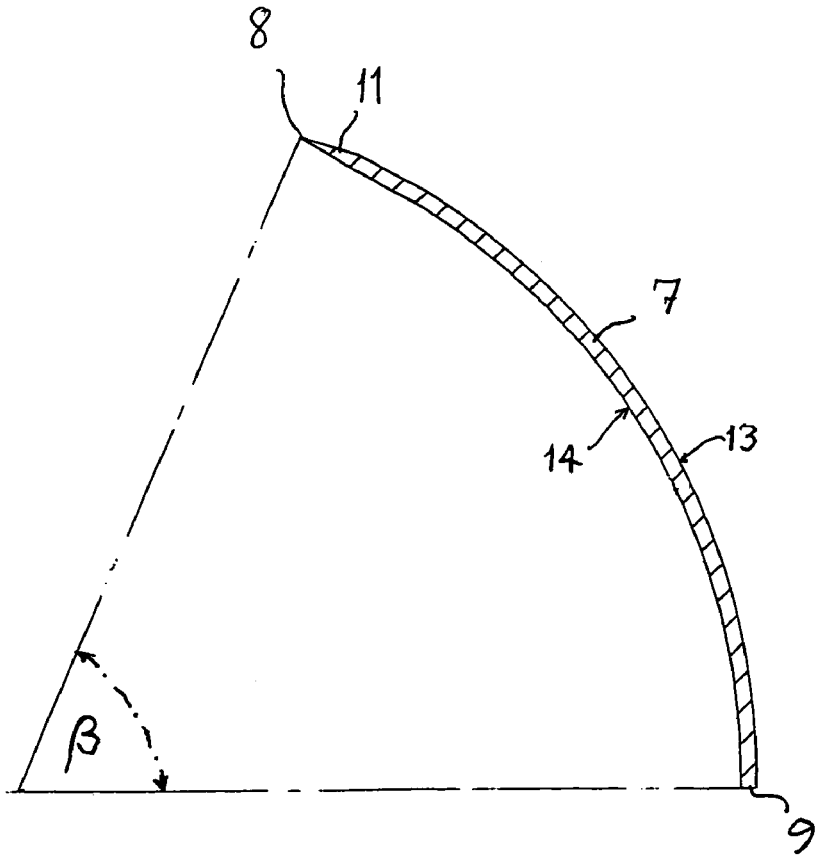
FIG. 11 is a cross-section through one of the blade members.
Figure 12:
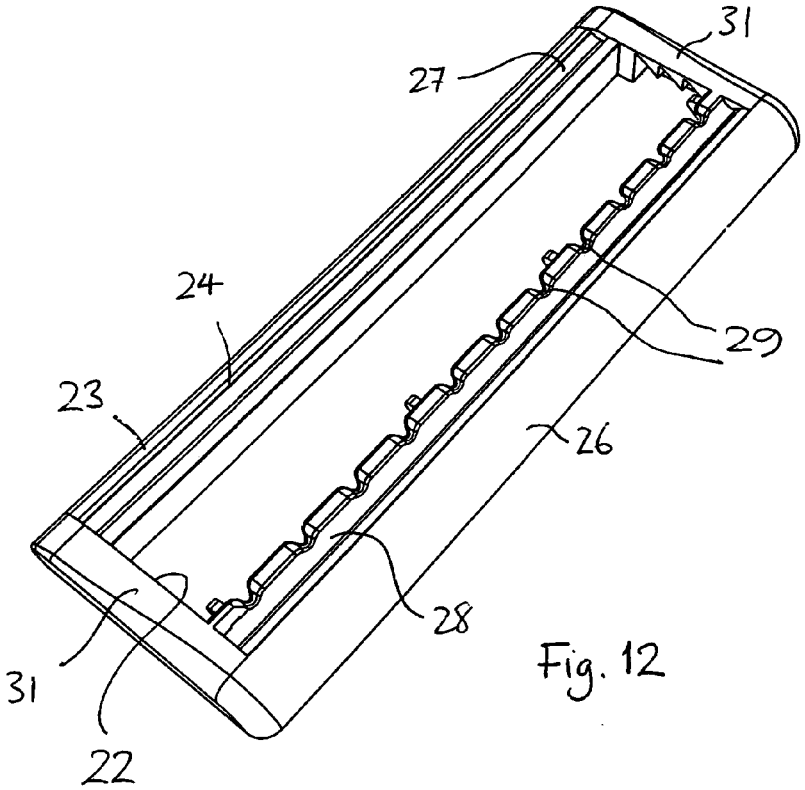
FIG. 12 is a perspective view of a first, lower part of the razor head, seen from below.
Figure 13:
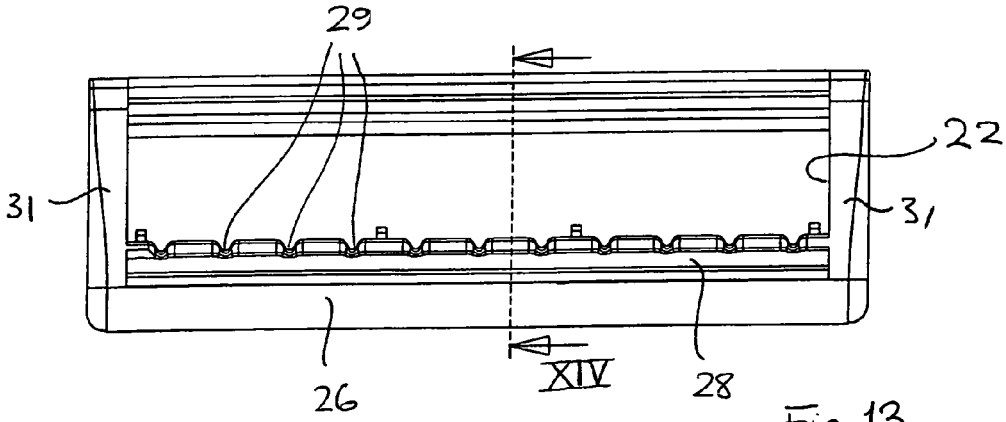
FIG. 13 is a bottom plan view of the first part.
Figure 14:
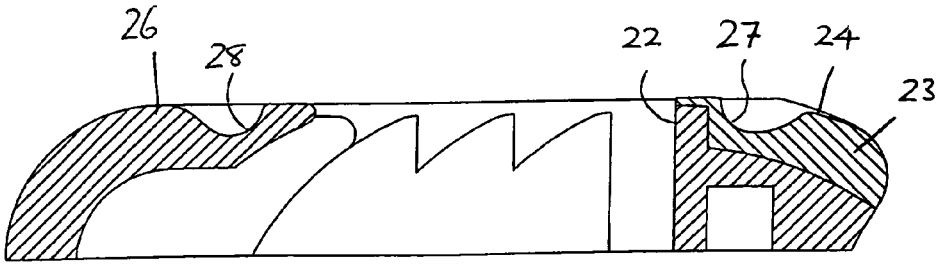
FIG. 14 is an enlarged section taken on line XIV-XIV in FIG. 13.
Figure 15:
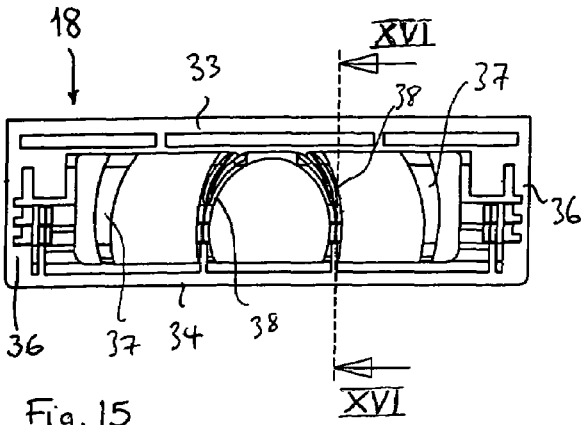
FIG. 15 is a bottom plan view of a second, upper part of the razor head.
Figure 17:
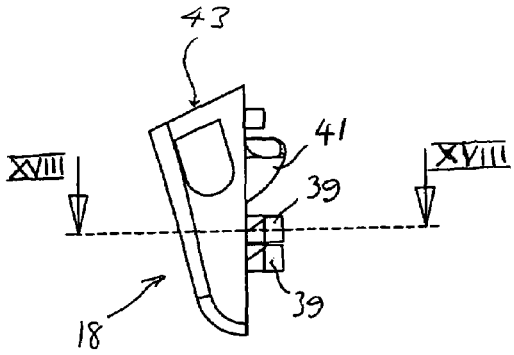
FIG. 17 is an end view of the second part.
Figure 16:
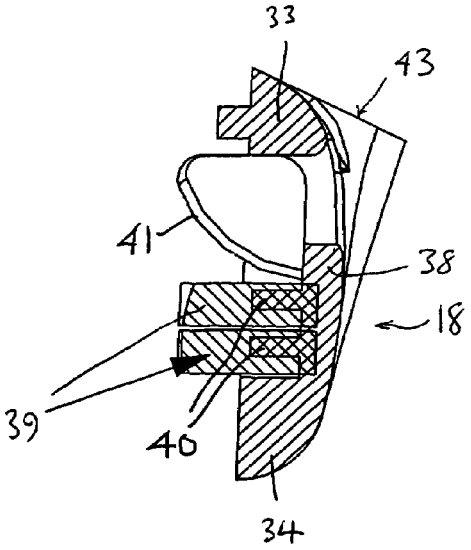
FIG. 16 is an enlarged section taken on line XVI-XVI in FIG. 15.
Figure 18:
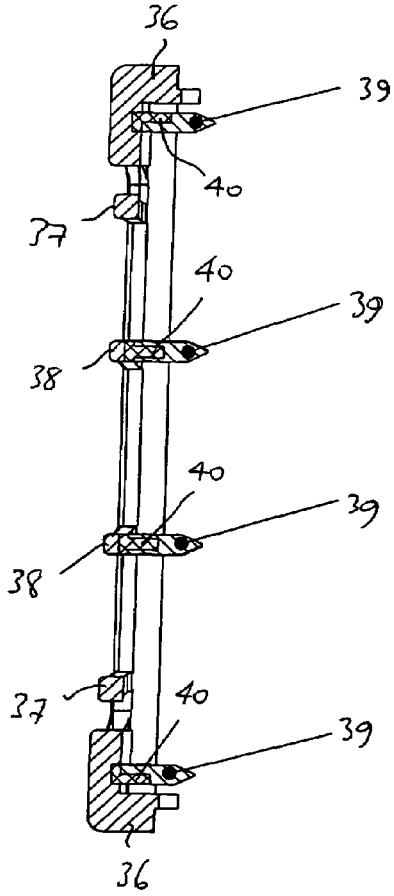
FIG. 18 is a section taken on line XVIII-XVIII in FIG. 17.

The cutting edges 8 lie in a cutting plane 12 and are mutually parallel in the embodiment illustrated. Each blade member 7 has a convex outer surface 13 facing towards the cutting plane 12 and an opposite concave inner surface 14. An imaginary median surface 16 (FIG. 10), mid-way between the outer and inner surfaces 13, 14, curves away from the cutting plane 12 and is in the form of a segment of a circular cylinder in the embodiment illustrated. The angle $\alpha$ between the median surface 16 and the cutting plane 12, at the cutting edge 8, is preferably at least 15° and preferably at most 30°, being for example 20°. The segment angle $\beta$ is preferably in the range from 50° to 75°, more preferably 60° to 70°.

The blade members 7 are identically curved and are arranged parallel to one another. This arrangement facilitates the passage of waste material (hair follicles and shaving lotion) through the head and can prevent excess build up of waste which would tend to raise the cutting edges 8 from the shaving surface. To enhance this effect, the spacing between the rear edges 9 could be made greater than that between the cutting edges 8. The curvature of the blade members allows the sharpened portions 11 to be offered up to the shaving surface at an optimum angle, while the blade members direct the waste material away from the shaving surface. The curved profile of the blade member enhances its longitudinal strength and minimises deformation of the cutting edge during use.

The blade members 7 are held between a first, lower head part 17 (which is adjacent the skin during shaving) and a second, upper head part 18. The head parts 17, 18 have complimentary curved blade-end supports 19, 21 respectively, which clamp respective end portions of the blade members 7 between them.

The first head 17 is in the form of a frame defining an opening 22 through which the cutting edges 8 of the blade members 7 are accessible. The frame includes a leading element 23 in the form of a hair erection strip which is provided with a frictional surface 24 having a higher coefficient of friction than the remaining surfaces of the frame and tending to pull the skin taut and erecting the hair follicles in its path as the razor head 2 is drawn across the skin during shaving. Both the leading element 23 of the frame and the trailing element 26 have respective gutters 27, 28 allowing for the collection and redistribution of pre-applied shaving solution (a lubricating liquid), in order to provide an accumulated shaving solution cushion allowing constant lubrication of the shaving surface during use. A plurality of ducts 29 communicate between the gutter 28 and the opening 22, keeping the gutter 28 well supplied with shaving solution during shaving.

Figure 3:
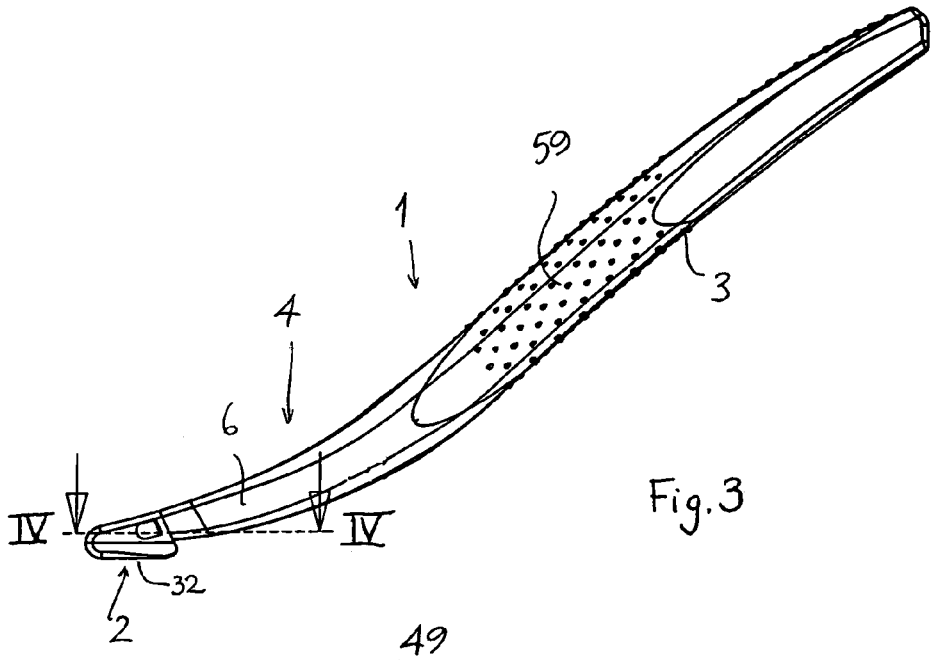
FIG. 3 is a side view of the razor.
Figure 4:
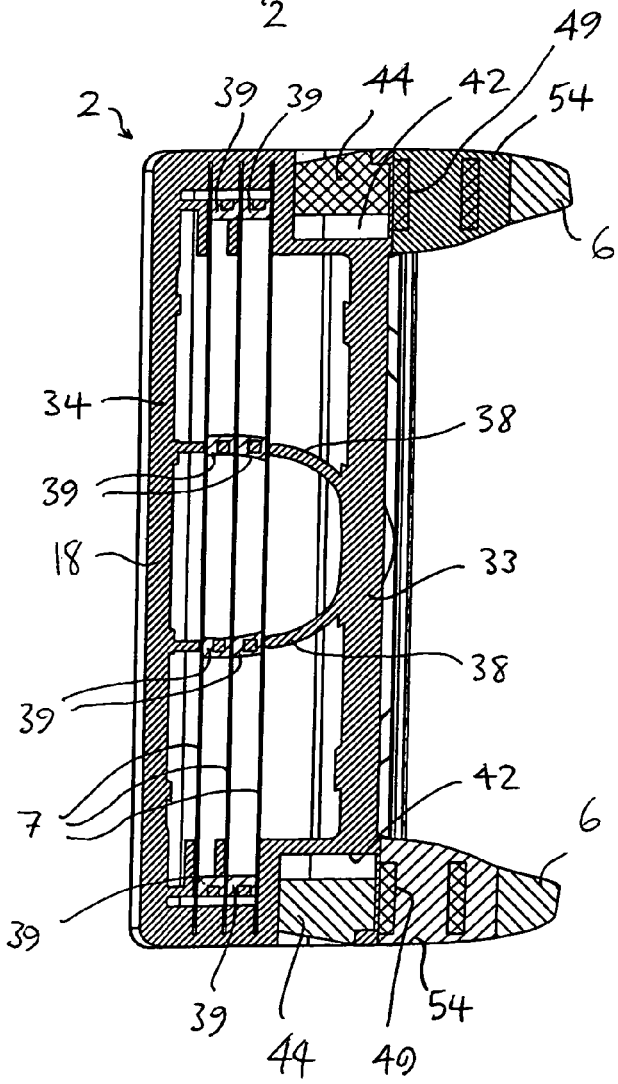
FIG. 4 is an enlarged section taken on line IV-IV in FIG. 3.
Figure 5:
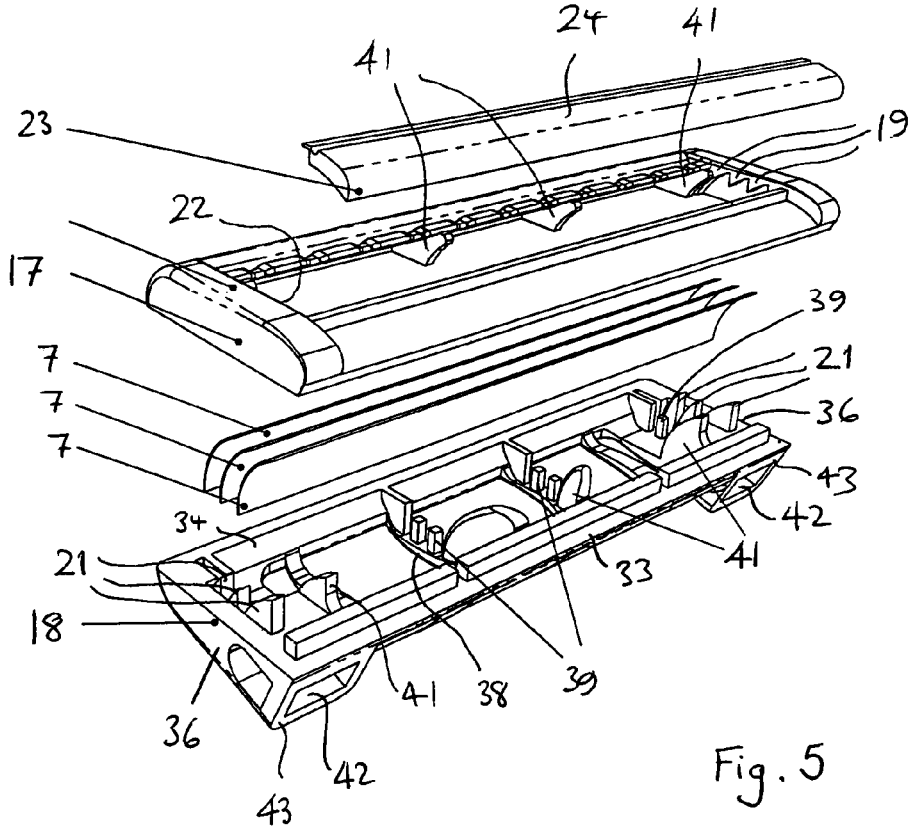
FIG. 5 is an exploded perspective view of the razor head, viewed from the underside.
Figure 6:
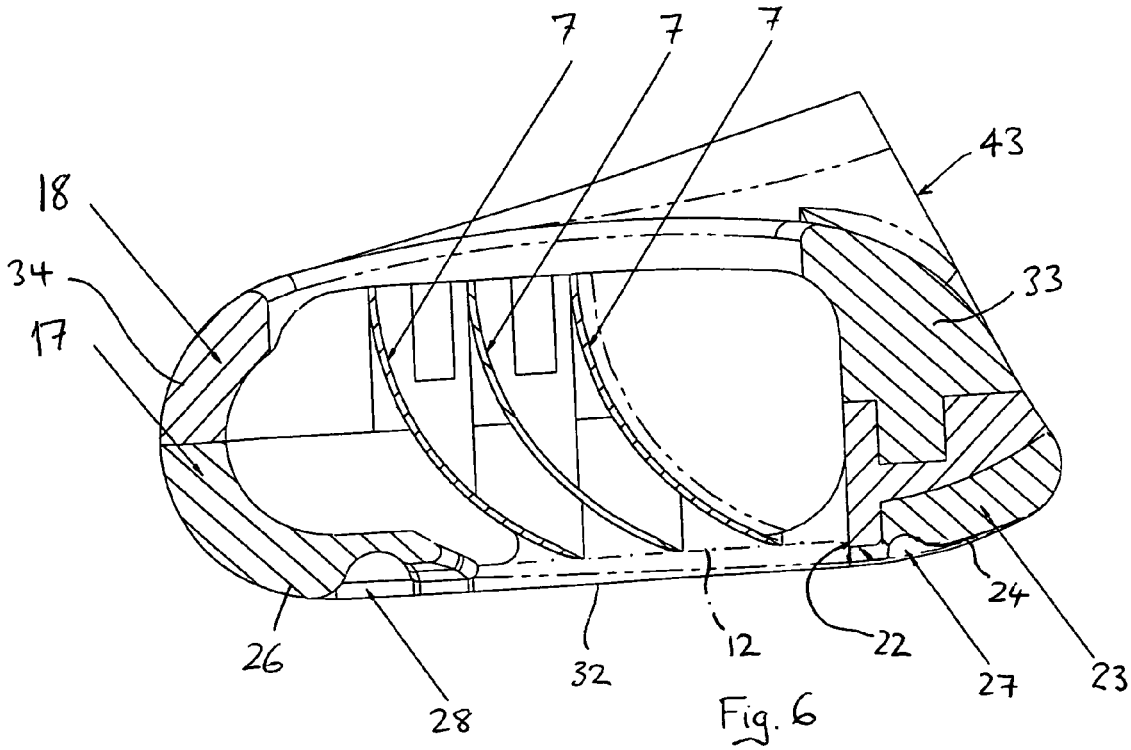
FIG. 6 is an enlarged cross-section through the razor head.
Figure 7:
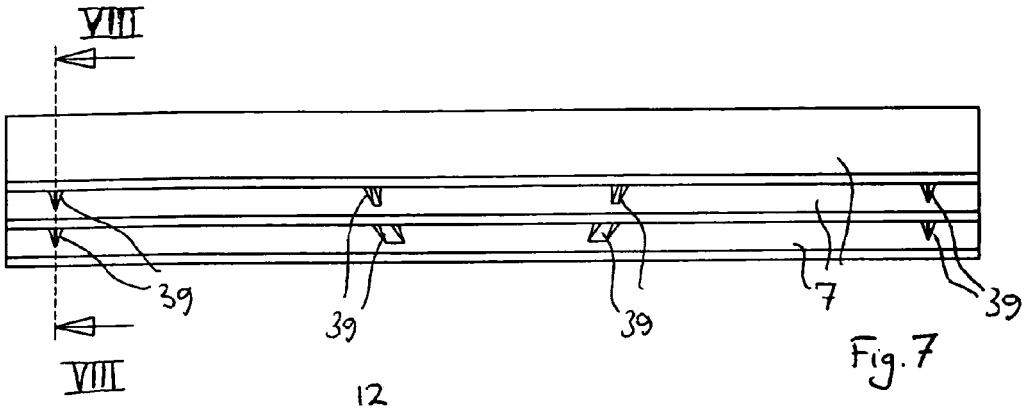
FIG. 7 is a bottom view of the blade members and flexible blade separators.
Figure 8:
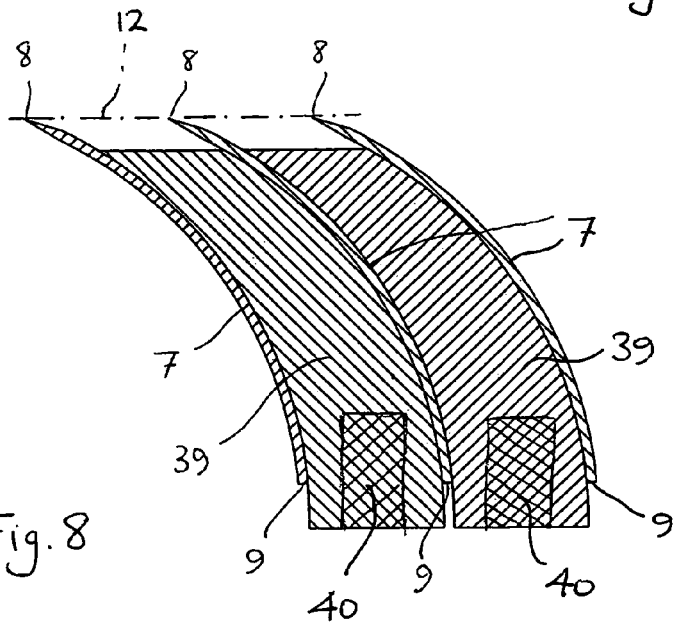
FIG. 8 is an enlarged section taken on line VIII-VIII in FIG. 7.
Figure 9:
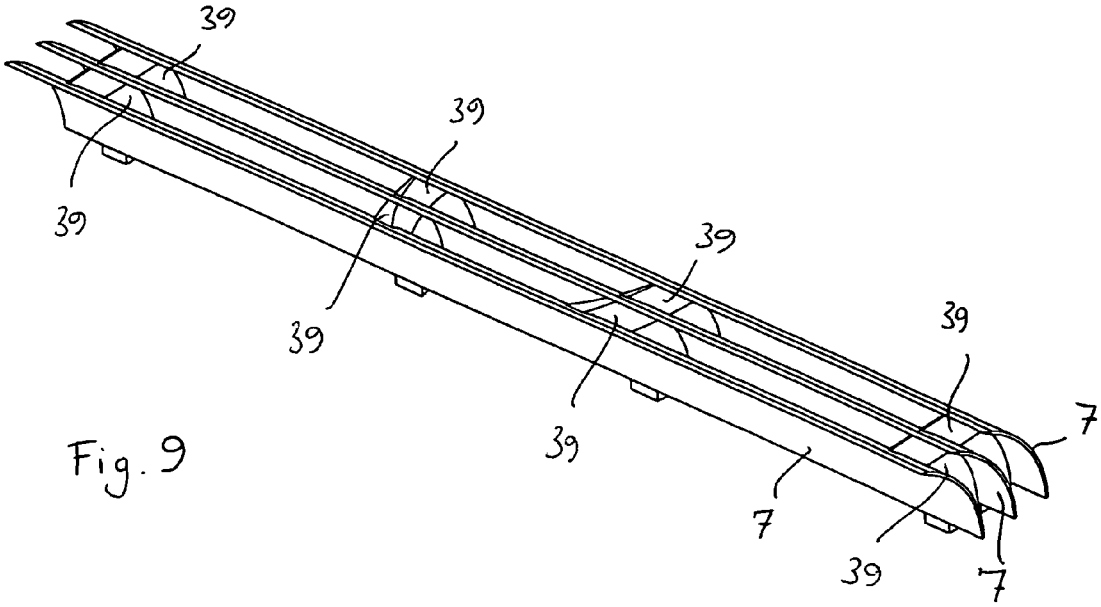
FIG. 9 is a perspective view corresponding to FIG. 7.

The frame also includes lateral elements in the form of raised skids 31, which assist in flattening the shaving surface during use. As best seen in FIG. 6, the plane of the shaving surface 32 tangential to the frame-forming elements 23, 26, 31 lies beyond the cutting plane 12 with respect to the blade members 7, thereby assisting in correct location of the cutting edges 8 in relation to the shaving surface. As best seen in FIG. 3, the elongate handle 1 is angled away from the plane of the shaving surface 32, the front end portion 4 curving away from that plane. For example, the angle between the median longitudinal axis of the shaft 3 and the shaving surface 32 may be in the range from 30° to 50°, in particular about 40°. This helps the user to present the razor head 2 to the skin. In combination with the forked front end portion 4, this is particularly convenient in use.

The second head part 18 is in the form of a frame having front and rear members 33, 34 and side members 36. Bridging members 37, 38 extend between the front and rear members 33, 34. The middle bridging members 38 and the side members 36 carry resiliently flexible blade supports 39 which maintain a constant spacing between the blade members 7 and minimise deformation of the blade members during shaving. Each flexible support 39 is carried by a relatively rigid pin 40, this structure being produced by two-shot molding, for example. Both head parts, 17, 18 also include relatively rigid blade supports 41.

Preferably, each of the first and second head parts 17, 18 is constituted by a single integrally molded part, which may be produced by one-shot molding, two-shot molding, or multi-shot molding. However, as shown in the drawings, it is possible for the hair erection strip 23 to be a separate piece. In another embodiment, the two head parts 17, 18 may both be constituted by a single integrally molded part so that they are connected by an integral hinge in the manner of a clam shell. Suitable materials for the construction of the head parts are thermoplastic elastomers (such as those available under the trade mark Santoprene). The head parts 17, 18 are bonded together by ultrasonic welding, for example.

Figure 19:
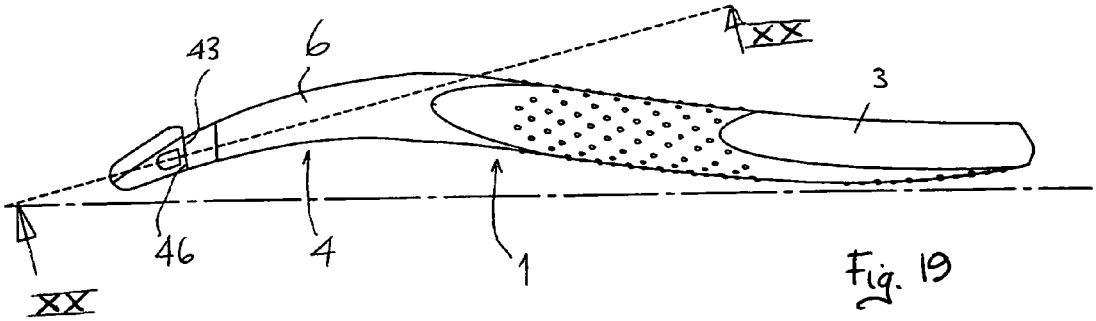
FIG. 19 is a side view of the razor.
Figure 20:
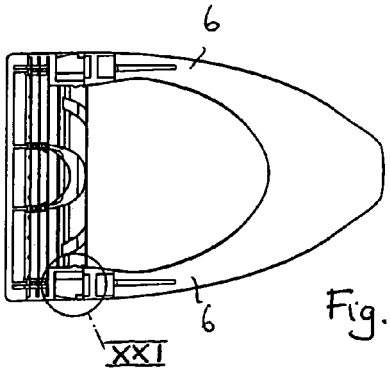
FIG. 20 is a section taken on line XX-XX in FIG. 19.
Figure 21:
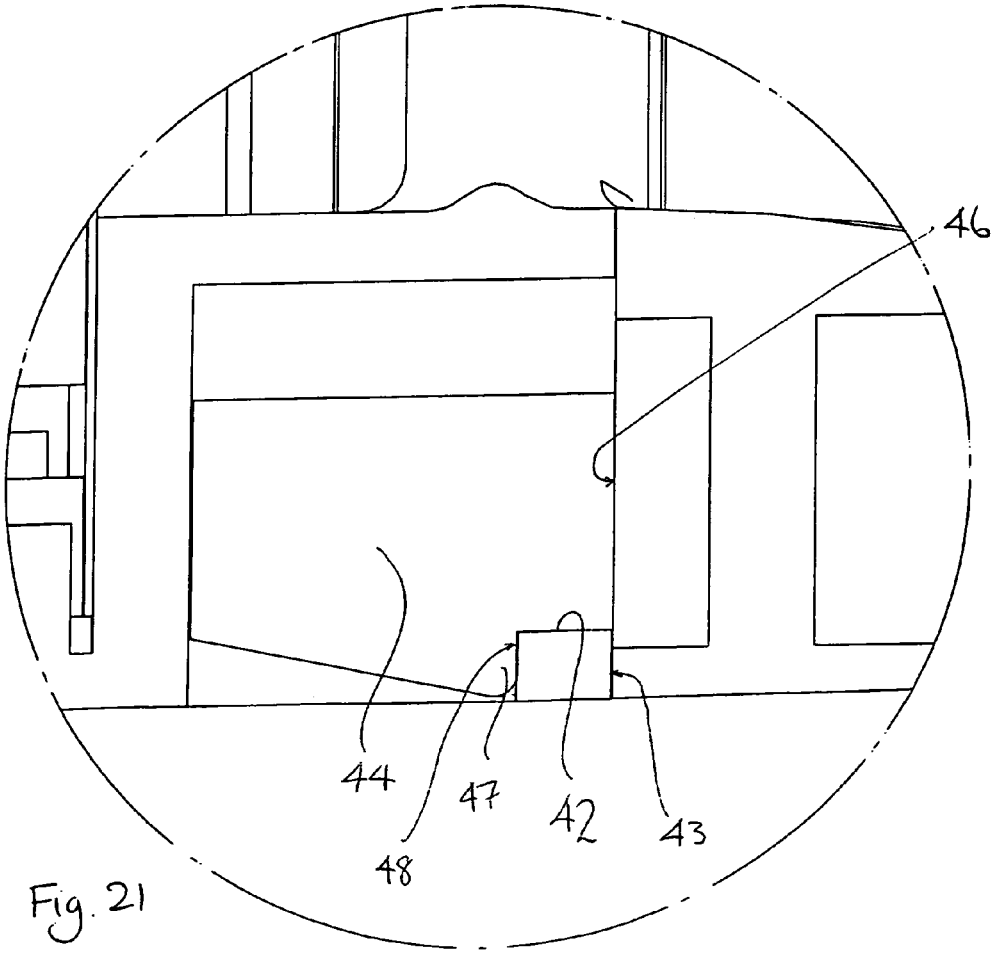
FIG. 21 is an enlarged view of the detail XXI indicated in FIG. 20.

The rear end of each side member 36 of the second part 18 of the razor head 2 has an undercut aperture 42 in a planar rear abutment surface 43. The distal ends of the fork arms 6 have detent elements 44 projecting forwardly from front abutment surfaces 46, which are also planar. Each detent element 44 has a shoulder 47 which engages against an undercut surface 48 in the aperture 42, while the front and rear abutment surfaces 43, 46 abut against one another; in this way the razor head 2 is fixed relative to the distal ends of the fork arms 6. This situation is illustrated in FIGS. 19 to 21.

Figure 22:
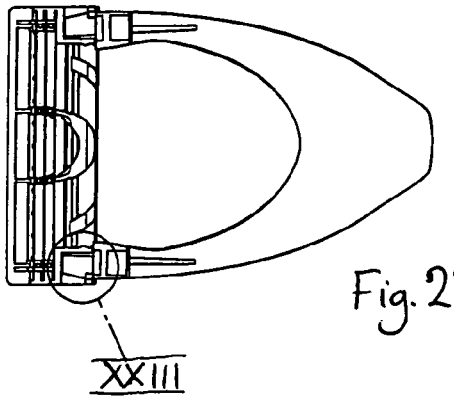
FIG. 22 is a view similar to FIG. 20, but with detent elements disengaged from undercut apertures in the razor head.
Figure 23:
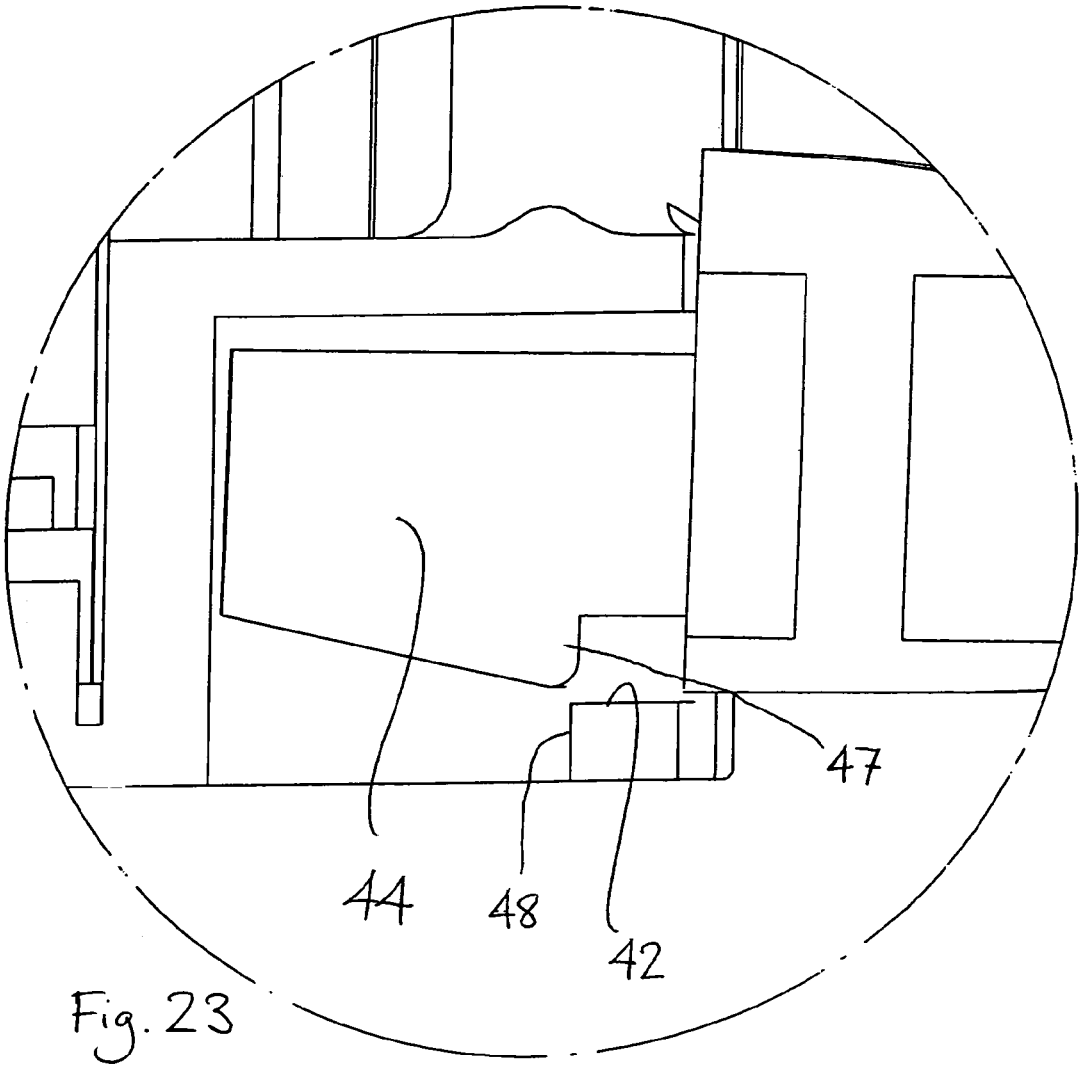
FIG. 23 is an enlarged view of the detail XXIII-XXIII indicated in FIG. 22.
Figure 24:
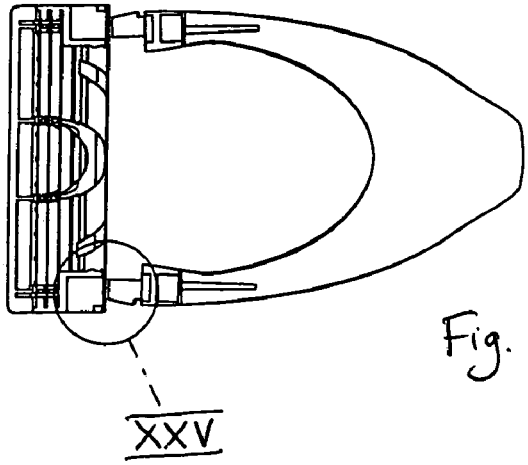
FIG. 24 is a view similar to FIGS. 20 and 22, but with the disengaged detents withdrawn from the undercut apertures.
Figure 25:
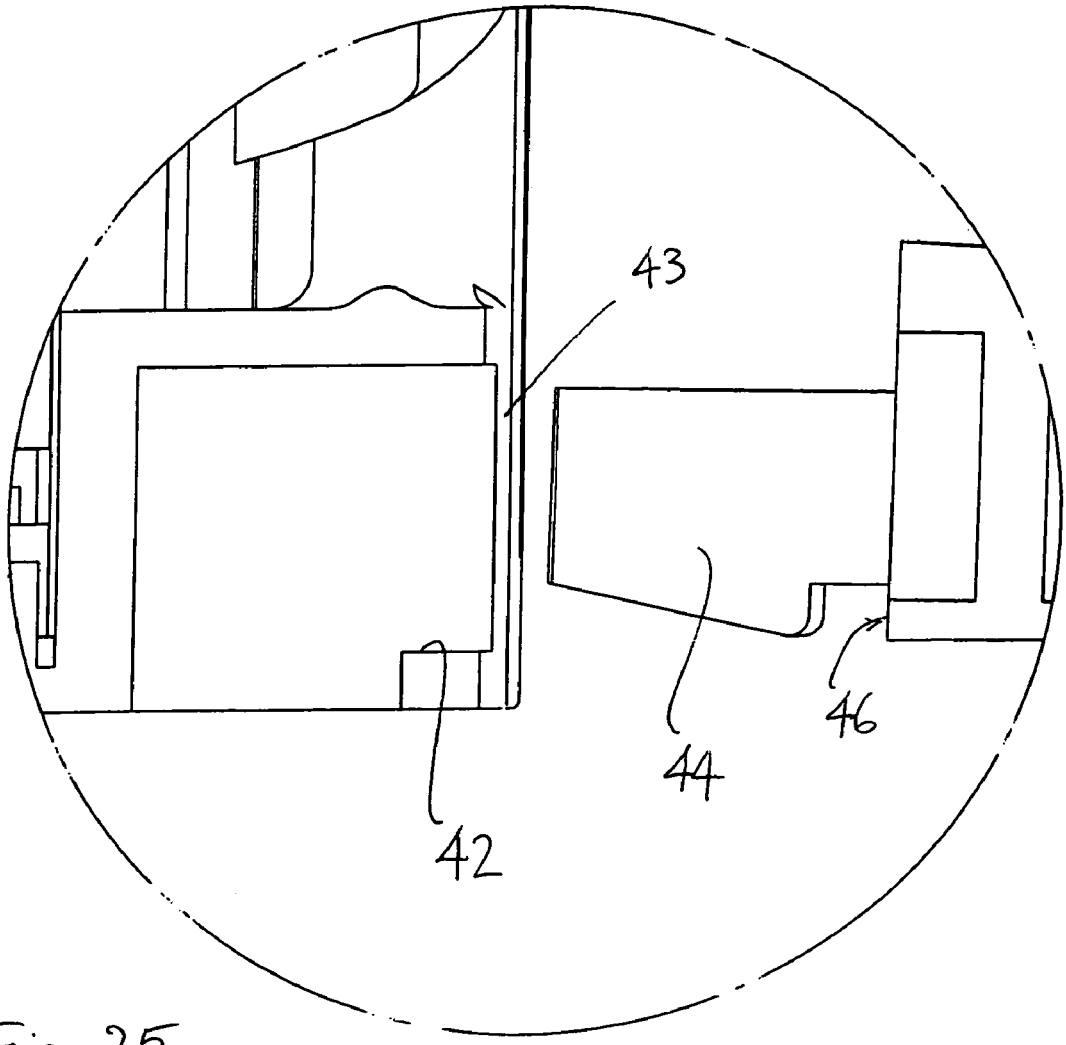
FIG. 25 is an enlarged view of the detail XXV-XXV indicated in FIG. 24.
Figure 26:
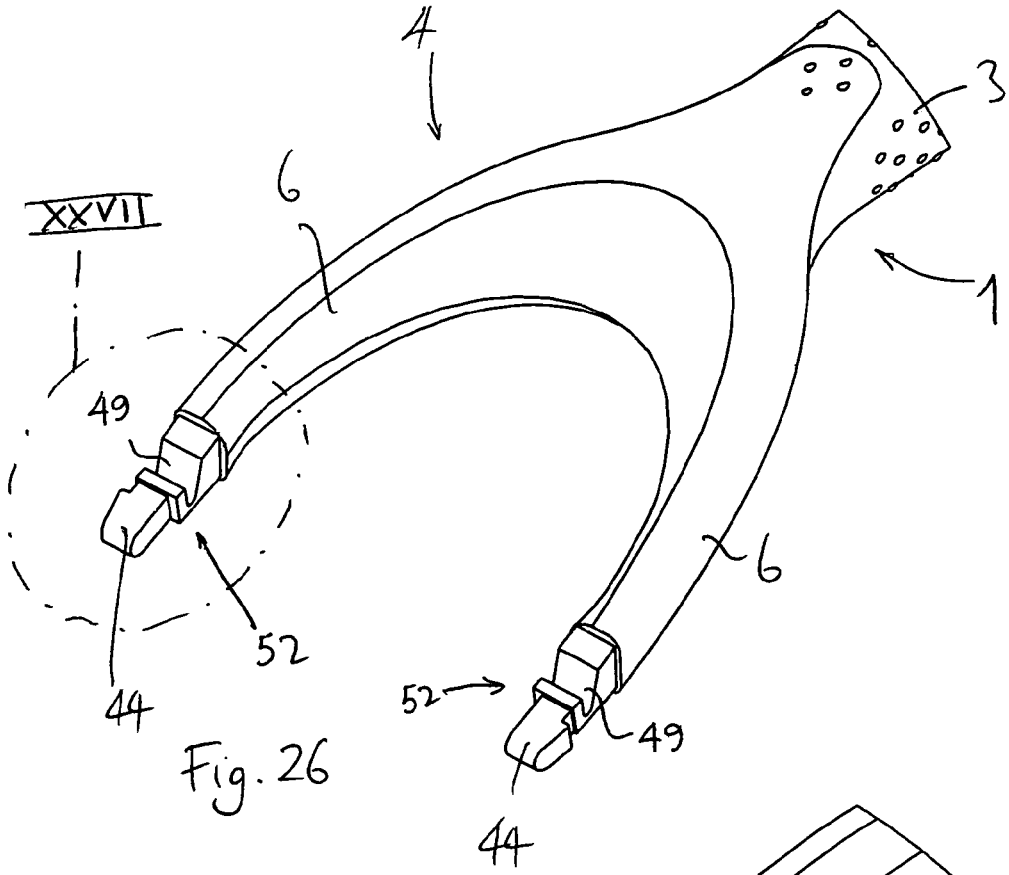
FIG. 26 is a perspective view of the forked end portion of the handle, seen from below, with grooved parts uncovered.
Figure 27:
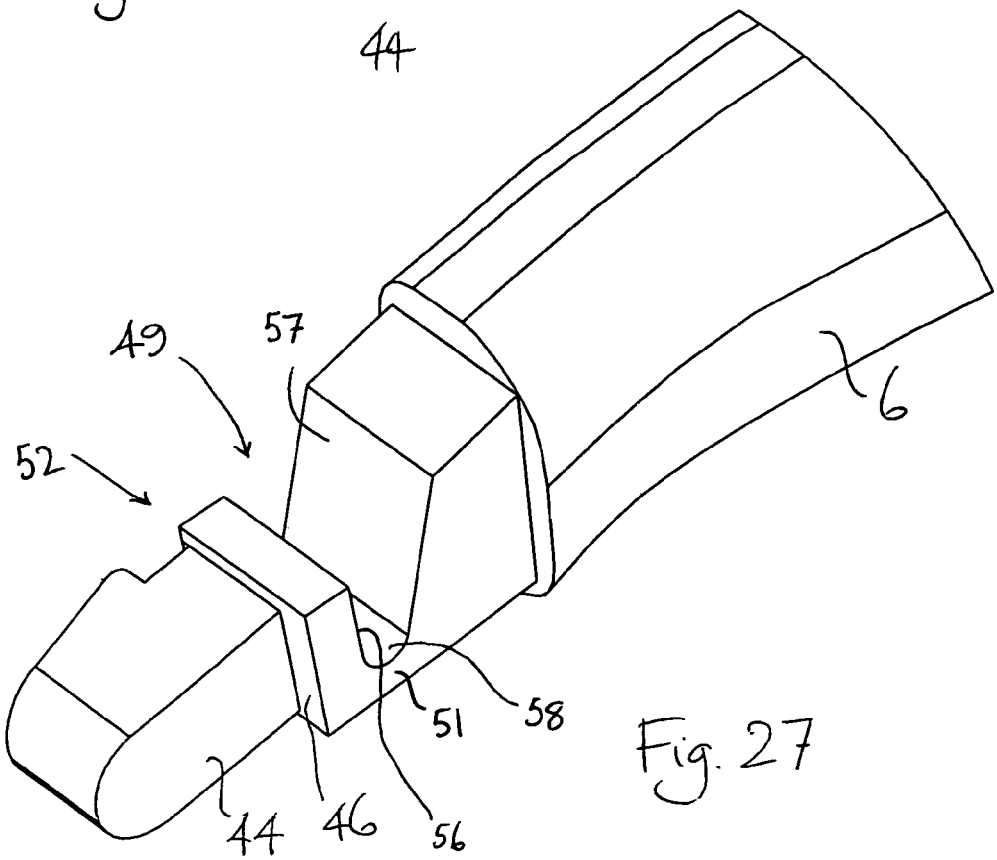
FIG. 27 is an enlarged view of the detail XXVII-XXVII indicated in FIG. 26.

In order to release the razor head 2 from the handle 1, the fork arms 6 are first squeezed towards each other, so that the shoulders 48 of the detent elements 44 are disengaged from the undercut surfaces 48 inside the apertures 42, as shown in FIGS. 22 and 23. Then the detent elements 44 are withdrawn from the undercut apertures 42, as shown in FIGS. 24 and 25.

Figure 28:
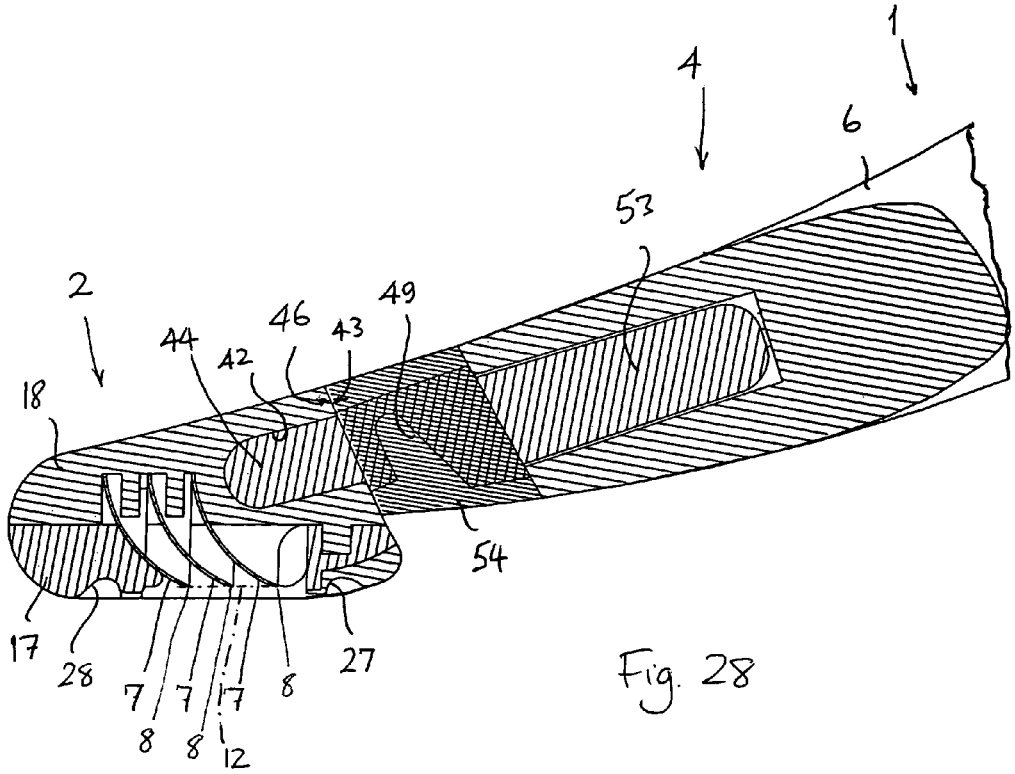
FIG. 28 is a cross-section through the razor head and one fork arm of the handle.

Although the razor head 2 is fixed in relation to the distal ends of the fork arms 6, it is desirable for the head to be able to pivot relative to the shank 3 about an axis parallel to the cutting edges 8 when a pivoting force is applied to the razor head during shaving. For this purpose, each fork arm 6 has a transverse groove 49, which leaves an integral hinge 51. The grooves 49 are mutually aligned on the same side of the forked end portion 4 of the handle 1. The arm portion 52 including the groove 49 and the detent element 44 may be integral with the remainder of the fork arm 6 or (as shown in FIG. 28) may be a separate part having a stub 53 fixed in the remaining part of the fork arm 6.

The part containing the groove 49 is encased in a resiliently deformable material 54 (such as thermoplastic elastomer) which adheres to the surfaces of the flexible part. As can be seen from FIG. 28, for example, the material 54 defines part of the front abutment surface 46. The resiliently deformable material in the groove 49 is stretched when a pivoting force is applied to the razor head 2 during shaving (allowing the groove 49 to open and the razor head 2 to pivot) and restores the razor head 2 to its normal position when the force is removed.

Figure 29:
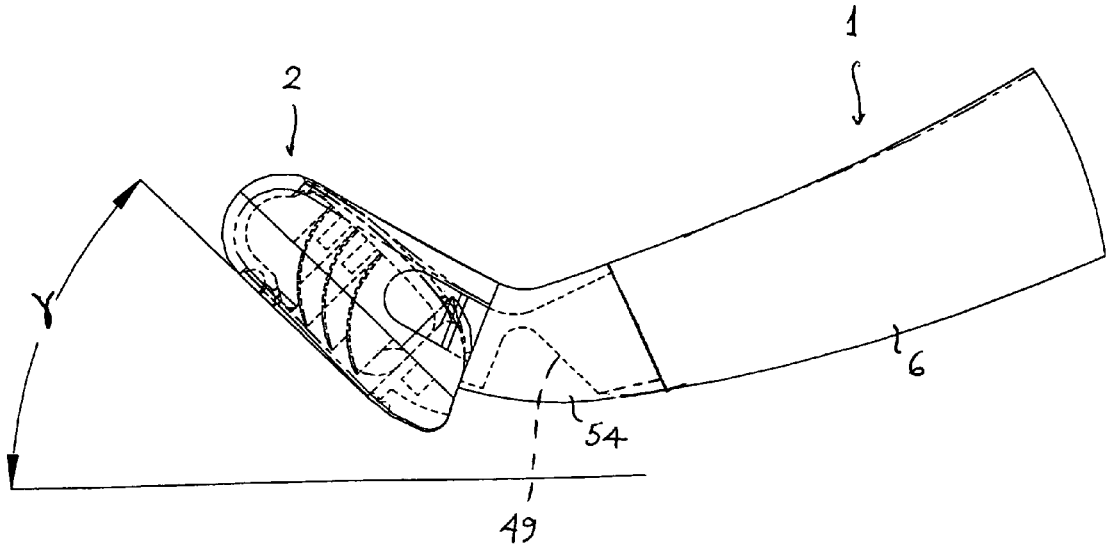
FIG. 29 is a side view corresponding to FIG. 28, but with the head pivoted to its maximum practical extent.

The groove 49 occupies approximately ¾ to ⅘ of the depth of the arm portion 52 and has a front wall 56 approximately parallel with the abutment surface 46, a rear wall 57 sloping away from the front wall 56, and a rounded base 58. The extensibility of the material 54 is such that the head 2 is pivotable relative to the handle 1, under normal shaving forces, through an angle $\gamma$ of up to at least 45°, for example, as shown in FIG. 29, preferably up to 65°.

The shaft 3 of the handle 1 is provided with a grip area 59, which extends around the shaft 3. The grip area 59 has a plurality of small protuberances 61 to aid gripping. The grip area 59 may be made of a different material from the remainder of the shaft 3 and, in particular, may be softer and may be a higher coefficient friction. The body of the handle 1, including the arms 6, may be made of a resilient deformable material so that the arms 6, as a whole, can be flexed towards each other by squeezing the forked portion 4 between finger and thumb. However, the body of the handle 1 may be made of a relatively rigid material, in which case each fork arm 6 may comprise a relatively flexible distal portion which is fixed to the relatively rigid proximal portion and contains the groove 49. A basic handle molding can be made out of any suitable material, for example thermoplastic elastomer, polypropylene, styrene or styrene-copolymer plastics, cast metal such as aluminum, or composite material such as carbon fiber. A handle made of thermoplastic elastomer could have a grip area made of a softer thermoplastic elastomer (e.g. by two-shot injection molding). A handle produced from carbon fiber may have a grip area made of aluminum or wood, for example.

Figure 30:
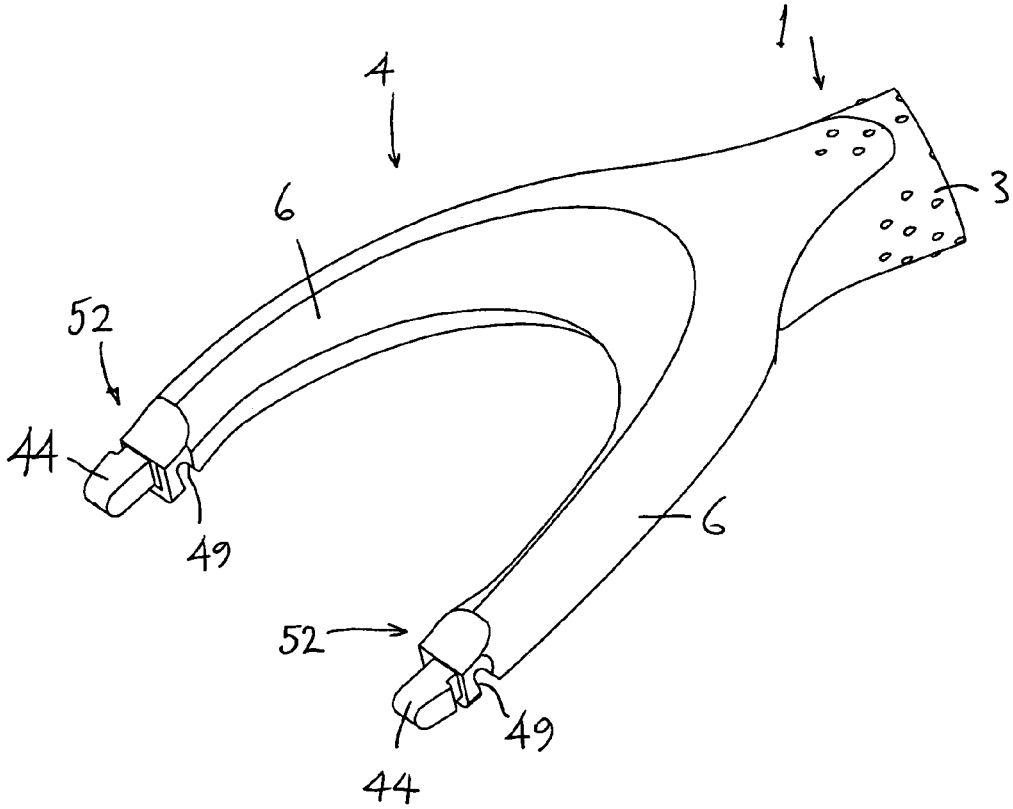
FIGS. 30 to 32 are similar to FIGS. 26 to 28, respectively, but show another embodiment of the razor handle.
Figure 31:
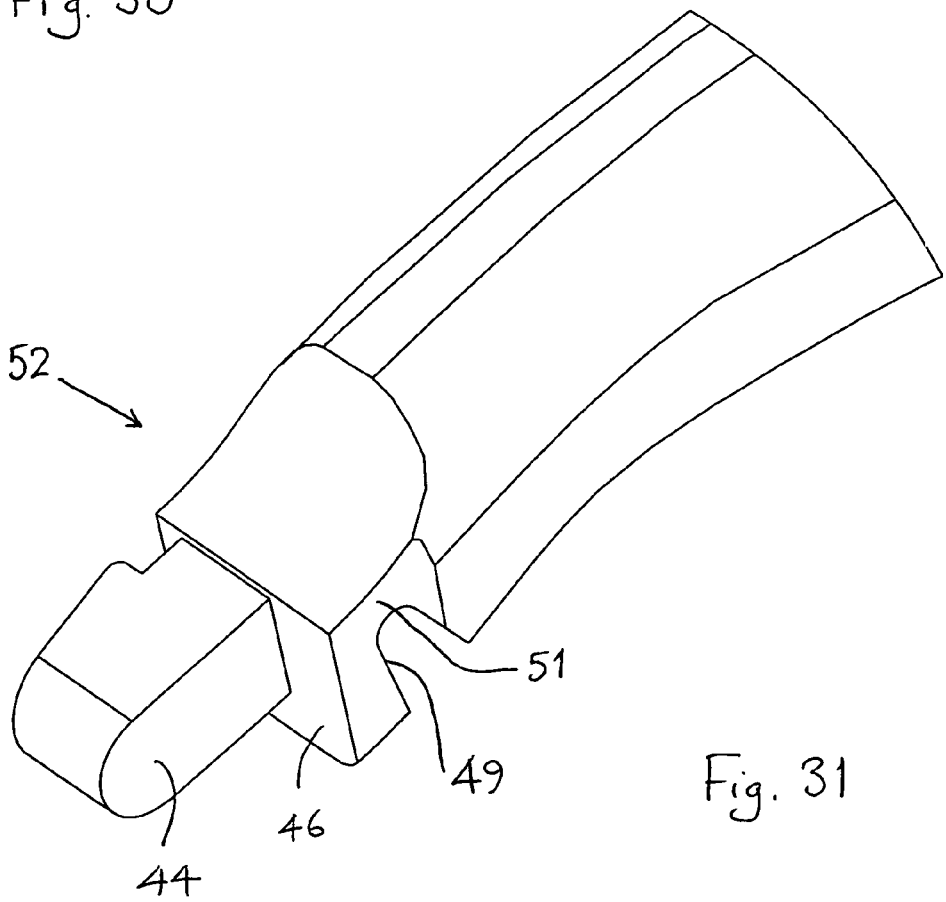
Figure 32:
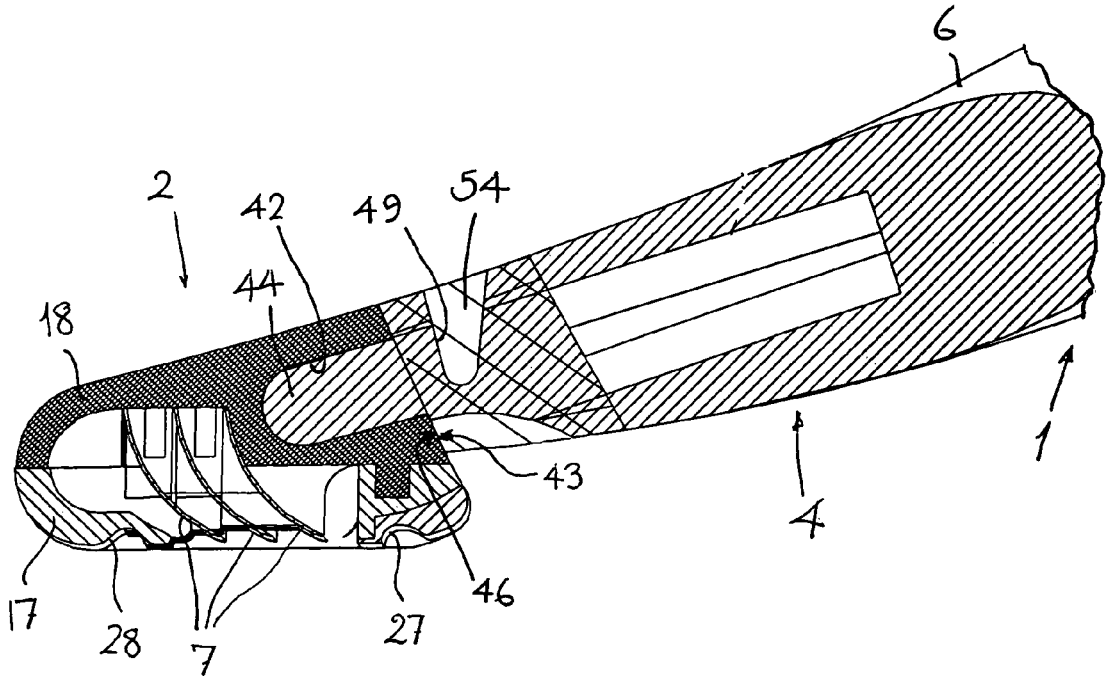

In the alternative embodiment illustrated in FIGS. 30 to 32, the grooves 49 are provided on the upper side of the front end portion 4 of the handle 1, so that the resiliently deformable material 54 in each groove 49 undergoes compression when the pivoting force is applied.

Various modifications may be made within the scope of the invention. For instance, although the razor blade has been described as having three blade members, which is the preferred number, it may be possible to use a single blade member, a pair of blade members, or four or more blade members. The cutting edges may be angled with respect to one another. The blade members may be of variable thickness. The radius of curvature may vary, in particular it may decrease in the direction away from the cutting edge. Instead of curved blade members, it may be possible to use straight blade members or bent blade members. The groove could be provided in a single arm forming a front end portion of the handle. The pivoting of the razor head could be achieved by replacing the grooves in the fork arms by any other convenient form of hinge. The razor head may be permanently fixed to the handle, in which case the blade members may be replaceably arranged or the razor as a whole may be disposable.

What is claimed as new and desired to be protected by Letters Patent of the United States is:

1. A razor comprising a handle and a disposable razor head having at least one blade member with a cutting edge extending along a head axis transverse to a handle axis, the razor handle having a front end portion, a distal end of the front end portion is connectable or connected to the razor head, the front end portion has a pair of fork arms, distal ends of the fork arms are connectable or connected in fixed relation to the razor head at positions adjacent to respective ends of the razor head, and each fork arm comprises a flexible and resilient distal portion and a groove which is located adjacent to and below the distal end of the fork arm, wherein said flexible and resilient distal portion deforms along said groove when a pivoting force is applied to the distal ends of the for arms by the razor head during shaving and restores the distal ends of the fork arms to a normal position when the force is removed; wherein the flexible and resilient distal portion of each fork arm is adapted to releasably engage with the razor head, and the razor head is pivotable about the groove in the distal portion of said fork arms.

2. A razor comprising a disposable razor head and a razor handle according to claim 1, wherein the groove in the flexible and resilient distal portion of each fork arm comprises a reduced thickness portion of the fork arm.

3. A razor comprising a disposable razor head and a razor handle according to claim 1, wherein the distal ends of the fork arms have detent elements engageable in undercut apertures in the razor head, the distal ends of the fork arms being movable toward one another to disengage the detent elements and allow them to be removed from the undercut apertures.

4. A razor comprising a disposable razor head and a razor handle according to claim 1, wherein the razor head includes razor handle attaching means for receiving corresponding attaching portions of the distal ends of the fork arms, in such a manner that the razor head is fixed relative to the distal ends of the fork arms, the distal ends being pivotable by means of the flexible distal portion on each fork arm about said grooves when a pivoting force is applied to the razor head during shaving.

5. A razor comprising a disposable razor head and a razor handle according to claim 1, wherein the razor head includes razor handle attaching means for receiving corresponding attaching portions of the distal ends of the fork arms, in such a manner that the razor head is fixed relative to the distal ends of the fork arms, the distal ends of the fork arms being pivotable by means of the flexible distal portion on each fork arm about said grooves when a pivoting force is applied to the razor head during shaving, and wherein the attaching means of the razor head comprises an undercut aperture in a rear abutment surface, and each corresponding attaching portion of the fork arms comprises a detent element projecting outwardly from a front abutment surface, the front and rear abutment surfaces abutting against one another and the detent elements engaging in the undercut apertures.

6. A razor comprising a disposable razor head and a razor handle according to claim 1, wherein the razor head is pivotable relative to the handle through an angle of up to 65°.

7. A razor comprising a disposable razor head and a razor handle according to claim 1, wherein the razor head includes razor handle attaching means for receiving corresponding attaching portions of the distal ends of the fork arms, in such a manner that the razor head is fixed relative to the distal ends of the fork arms, the distal ends of the fork arms being pivotable by means of the flexible distal portion on each fork arm about said grooves when a pivoting force is applied to the razor head during shaving, and wherein the razor head defining a shaving surface toward which the cutting edge is directed and a reverse surface opposite the shaving surface, the front end portion of the handle is connected to the razor head between the shaving surface and the reverse surface, the handle being angled away from a plane tangential to the shaving surface.

8. A razor comprising a disposable razor head and a razor handle according to claim 1, wherein the razor head includes razor handle attaching means for receiving corresponding attaching portions of the distal ends of the fork arms, in such a manner that the razor head is fixed relative to the distal ends of the fork arms, the distal ends being pivotable by means of the flexible distal portion on each fork arm about said grooves when a pivoting force is applied to the razor head during shaving, and wherein the attaching means of the razor head comprises an undercut aperture in a rear abutment surface, and each corresponding attaching portion of the fork arms comprises a detent element projecting outwardly from a front abutment surface, the front and rear abutment surfaces abutting against one another and the detent elements engaging in the undercut apertures, and wherein the razor head defining a shaving surface toward which the cutting edge is directed and a reverse surface opposite the shaving surface, the front end portion of the handle is connected to the razor head between the shaving surface and the reverse surface, the handle being angled away from a plane tangential to the shaving surface and the front end portion of the handle curves away from said plane.

9. A razor comprising a disposable razor head and a razor handle according to claim 1, wherein the razor head includes razor handle attaching means for receiving corresponding attaching portions of the distal ends of the fork arms, in such a manner that the razor head is fixed relative to the distal ends of the fork arms, the distal ends being pivotable by means of the flexible distal portion on each fork arm about said grooves when a pivoting force is applied to the razor head during shaving, and wherein the attaching means of the razor head comprises an undercut aperture in a rear abutment surface, and each corresponding attaching portion of the fork arms comprises a detent element projecting outwardly from a front abutment surface, the front and rear abutment surfaces abutting against one another and the detent elements engaging in the undercut apertures, and wherein the razor head defining a shaving surface toward which the cutting edge is directed and a reverse surface opposite the shaving surface, the front end portion of the handle is connected to the razor head between the shaving surface and the reverse surface, the handle being angled away from a plane tangential to the shaving surface and the front end portion of the handle curves away from said plane, and the front end portion curves away from the said plane tangential to the shaving surface.

10. A razor comprising a disposable razor head and a razor handle according to claim 1, wherein the disposable razor head includes a frame defining an opening through which the cutting edge of the blade member is accessible, the frame including a leading element toward which the cutting edge is directed and a trailing element opposite the leading element, wherein at least one of the leading and trailing elements has a longitudinal gutter in which a lubricating liquid accumulates during shaving.

* * * * *